United States Patent [19]

Koike et al.

[11] Patent Number: 5,030,292

[45] Date of Patent: Jul. 9, 1991

[54] METHOD FOR CLEANING A THERMAL HEAD

[75] Inventors: Seiji Koike, Shizuoka; Takeshi Tashiro, Mishima; Kazuhiro Fushimi, Mishima, all of Japan

[73] Assignee: Tokyo Electric Co., Ltd., Tokyo, Japan

[21] Appl. No.: 464,942

[22] Filed: Jan. 16, 1990

[30] Foreign Application Priority Data

Jan. 24, 1989 [JP] Japan ..... 1-14618

[51] Int. Cl.[5] ..... B08B 1/02

[52] U.S. Cl. ..... 134/32; 134/40; 134/6

[58] Field of Search ..... 134/32, 40, 6

[56] References Cited

U.S. PATENT DOCUMENTS

| | | | |
|---|---|---|---|
| 3,008,852 | 11/1961 | Valiulis | 134/6 X |
| 3,069,815 | 12/1962 | Valentine | 134/6 X |
| 3,574,261 | 4/1971 | Bailey | 134/37 X |
| 4,507,155 | 3/1985 | Cheek | 134/6 |
| 4,644,370 | 2/1987 | Watanabe | 346/76 PH |

FOREIGN PATENT DOCUMENTS

| | | |
|---|---|---|
| 42312 | 11/1973 | Australia . |
| 71493 | 12/1987 | Australia . |
| 55-152078 | 11/1980 | Japan . |
| 63-104868 | 10/1988 | Japan . |

*Primary Examiner*—Theodore Morris
*Assistant Examiner*—Saud Chaudhri
*Attorney, Agent, or Firm*—Frishauf, Holtz, Goodman & Woodward

[57] ABSTRACT

A method for cleaning a thermal head with a raised portion formed on a printing surface portion corresponding to a heat generating element. The method comprises passing a nonwoven sheet, havng an alcohol-impregnated forward portion and a dried rear portion, between a printing surface of the thermal head and a platen, upon the rotation of the platen, in a fashion compressed therebetween to allow the printing surface to be cleaned with the alcohol impregnated in the forward portion of the nonwoven sheet and the alcohol to be sucked in the dried rear portion of the nonwoven sheet.

12 Claims, 3 Drawing Sheets

METHOD FOR CLEANING A THERMAL HEAD

BACKGROUND OF THE INVENTION

1. Field of the Invention

The present invention relates to a method for cleaning a thermal head, relative to an opposed platen, which prints a character on a sheet fed into a gap between the head and the platen.

2. Description of the Related Art

A label printer as shown, for example, in FIG. 1 is known as an apparatus using a thermal head. A supply roll 1 on which a "label" web is wound is provided on an external location of a body. The label web 2 is fed from the supply roll 1 and past a guide 3 into a gap between a platen 4 and a thermal head 5. An ink ribbon supply roll 6 is provided in the apparatus. An ink ribbon 7 is fed from the roll 6 past guide rolls 8 and 9 into the gap between the platen 4 and the thermal head 5 and from there past a guide roll 10 to a take-up roll 11 where it is wound.

The thermal head 5 is brought into proximity to the platen side with the web 2 and ink ribbon 7 sandwiched therebetween and comes into contact with the ink ribbon 7 to print a character on the web 2.

In order to increase an intimate contact between the web 2 and the thermal head 5, the thermal head 5 as shown in FIG. 2 has a somewhat raised printing surface portion in its width direction at an area where a heat generating element 5*a* is buried. During a prolonged use of the thermal head 5, an ink deposit, paper dust and so on are attached to the side surface of the raised surface portion of the thermal head, posing problems upon printing, such as blurred character impression or soiled paper.

For this reason, the thermal head is swingably mounted relative to the body and, upon the occurrence of an inconvenience, or its likelihood, upon printing, it is swung away from the body so that the printing surface of the head may be cleaned (Japanese Patent Disclosure (KOKAI) 58-36479).

In order to allow the thermal head to be swung relative to the body, extra members are necessary and a corresponding arrangement becomes complicated due to the swinging motion of the thermal head and the maintenance of that motion. Further, if their mounting operation is not exactly done, the inconveniences are produced upon printing.

For this reason, with the thermal head mounted relative to the body, a deposit on the near-forward end portion of the thermal head 5 is manually rubbed out by a pen type cleaning unit 12 with a silicone impregnated at the tip of a felt as shown in FIG. 3.

Even if the pen type cleaning unit 12 is used, the tip end of the unit 12 may be accessed to a narrower clearance between the platen 4 and the thermal head, but an adequate cleaning cannot be effected over the whole surface of a printing area. A cumbersome operation is, therefore, necessary.

SUMMARY OF THE INVENTION

It is accordingly the object of the present invention to provide a method for cleaning a thermal head, which can positively clean the printing surface of the thermal head readily without detaching the head away from a body.

BRIEF DESCRIPTION OF THE DRAWINGS

FIGS. 4 to 6 are views for explaining one embodiment of the present invention, in which FIG. 4 shows a nonwoven fabric impregnated with a cleaning liquid, FIG. 5 is a diagrammatic view showing the state of a cleaning operation, and FIG. 6 is a diagrammatic view, partly enlarged, showing a label printer upon printing and a cleaning sheet;

DETAILED DESCRIPTION OF THE PREFERRED EMBODIMENTS

One embodiment of the present invention will be explained below with reference to the accompanying drawings.

Figure 1:
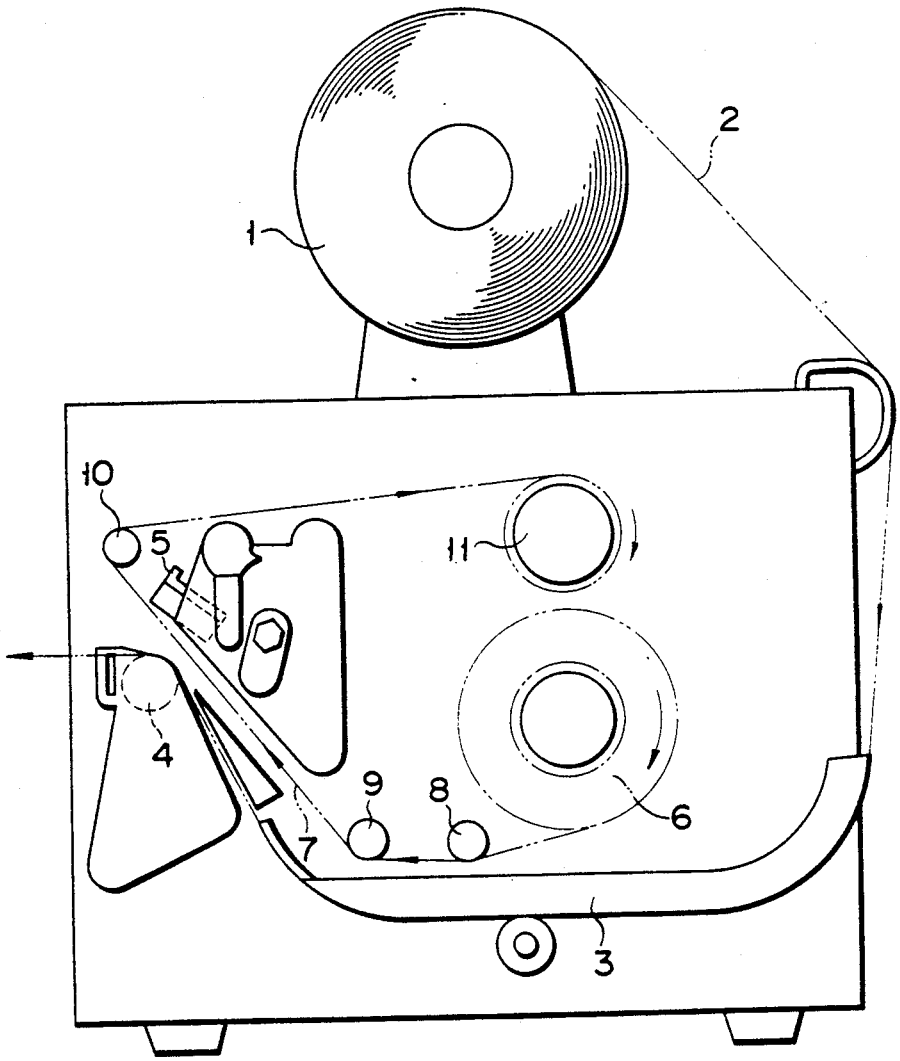
FIG. 1 (PRIOR ART)
FIG. 1 is a diagrammatic view showing a label printer having a thermal head to which a present cleaning method is applied.
Figure 2:
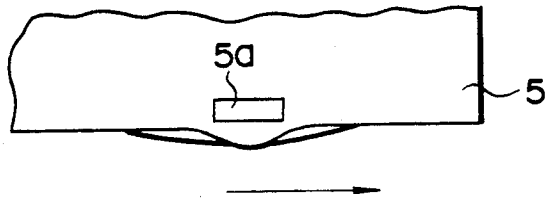
FIG. 2 (PRIOR ART)
FIG. 2 shows a state in which a foreign deposit is built up on the surface of a thermal head.
Figure 3:
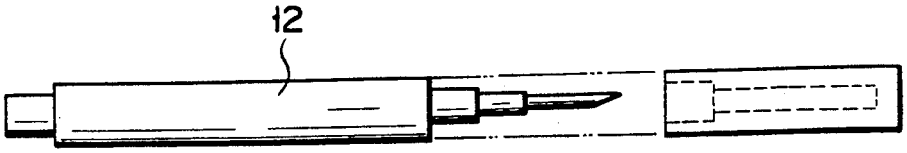
FIG. 3 (PRIOR ART)
FIG. 3 is a view showing a conventional cleaning unit.
Figure 4:
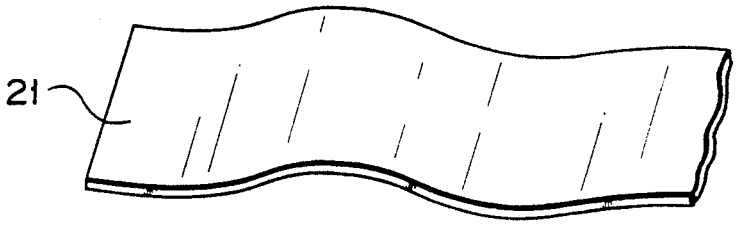

As shown in FIG. 4, a nonwoven sheet 21 is prepared which is composed of polyester fibers or contains polyester fibers. Alcohol is impregnated as a cleaning liquid in substantially one half forward end portion of the nonwoven sheet 21 to provide a cleaning sheet. As the nonwoven sheet 21, use may preferably be made of one having over 60% polyester fiber content, such as SHACHIHATA FSHO 34 (polyester fiber content: 100%) and DOMIE-125-000 (polyester fiber content: 60%, polyurethane fiber content: 40%). The cleaning sheet is not restricted to the nonwoven sheet so long as it allows a cleaning liquid to be impregnated therein. The sheet is preferably made substantially equal in width to the width of the printing surface of the thermal head. Further, it is preferred that the thickness of the sheet not be too great, taking into consideration the gap between the thermal head and the platen.

Figure 5:
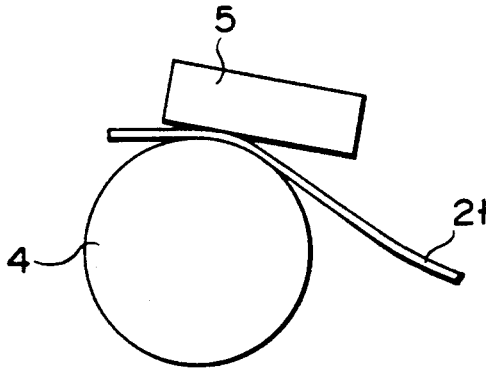

As shown in FIG. 5, the forward end portion of the cleaning sheet 21 is inserted into a gap between the platen 4 rotated counterclockwise by a motor, not shown, on one hand and the thermal head 5 on the other hand and pressed by the thermal head into contact with the platen 4. In this state, a cleaning mode switch of the platen 4 is turned ON and, by so doing, the platen 4 is rotated, for a predetermined time period, in the same way as at the time of feeding the sheet.

Figure 6:
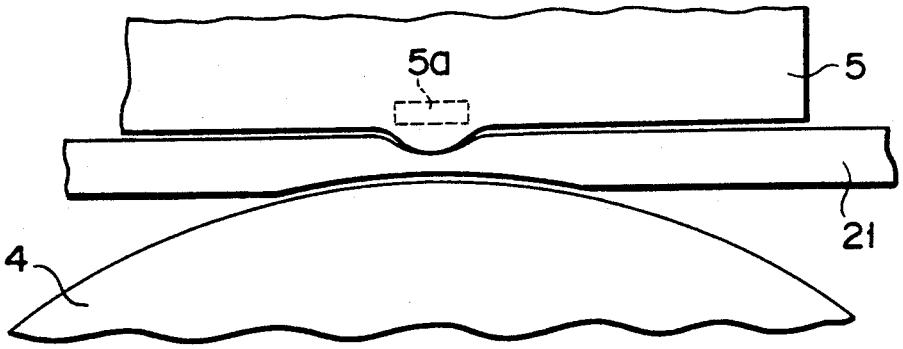

As shown in FIG. 6, the cleaning sheet 21 is compressed upon being passed, in particular, between the forward end portion of the thermal head 5 and the platen 4, allowing alcohol which has been impregnated in the cleaning sheet to flow at or near the raised portion of the printing surface of the head, in particular, at the side surface of the raised portion of that printing surface, across the whole width of the cleaning sheet. The alcohol thus flowing out of the cleaning sheet is attached mainly to the side surface of the aforementioned raised portion of the printing surface and penetrates a foreign deposit on the thermal head to allow that soiled spot to be cleaned readily. In this state, a rear half portion, dried and not impregnated with alcohol, of the nonwoven sheet 21 passes between the platen and the thermal head, causing the deposit which has been built up on the printing surface spot to be rubbed out, while, at the same time, sucking the flowing alcohol off the thermal head.

It is thus possible to rub out the soiled surface of the thermal head into a cleaned state by a simpler operation, that is, by feeding the cleaning sheet past a gap between the platen 4 and the thermal head 5 in an intimately contacting fashion without involving any cumbersome operation. Since the nonwoven sheet 21, upon being passed between the thermal head and the platen, intimately contacts with the thermal head across the whole width, it is possible to adequately clean out the soiled surface of the head over the whole surface.

Another embodiment of the present invention will be explained below with reference to FIG. 7.

Figure 7:
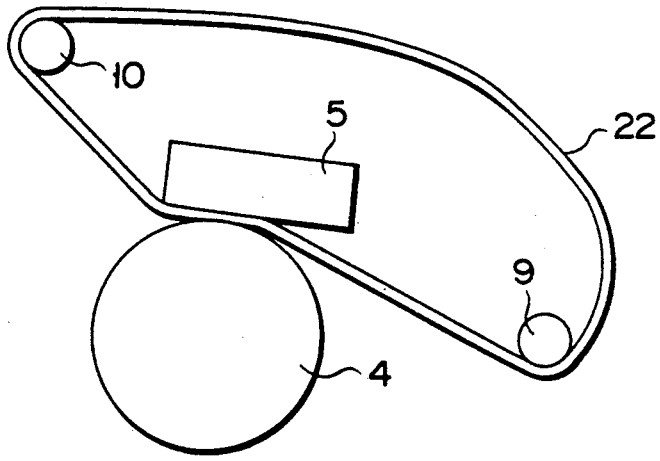
FIG. 7 is a diagrammatic view showing the state of a cleaning operation according to another embodiment of the present invention.

In the embodiment shown in FIG. 7, an endless type nonwoven sheet 22 is employed which passes between a platen 4 and a thermal head 5 in which case it passes guide rolls 9 and 10.

This embodiment can obtain the same advantage as those of the previous embodiment.

In this case, a cleaning liquid such as alcohol may be impregnated in the forward half portion of the endless nonwoven sheet, but, in order to display the endless belt feature, the cleaning liquid may be impregnated over the whole area and, in this case, the endless sheet is preferably rotated several times.

Figure 8:
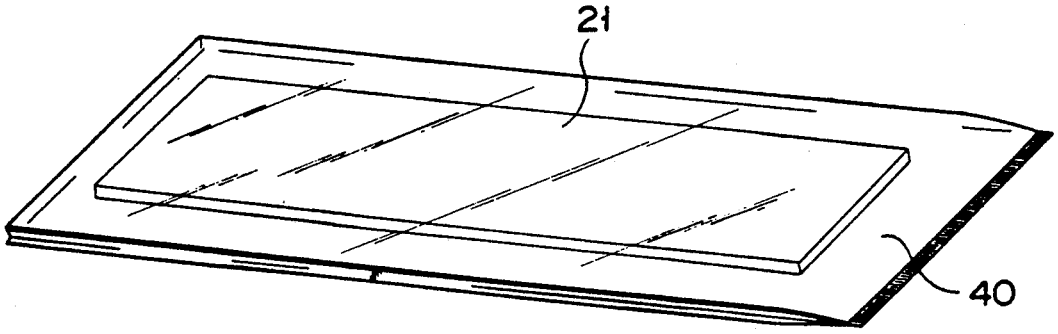
FIG. 8 shows a perspective view showing one form of a cleaning sheet in a packed state.

FIG. 8 shows a case where the aforementioned sheet is sealingly packed in a synthetic resin bag 40 for sale or temporary storage. In this case, the cleaning liquid may or may not initially be impregnated in the nonwoven sheet. In the latter case, the sheet is impregnated with the cleaning liquid after it has been taken out of the bag.

As the cleaning liquid use is preferably made of alcohol. If silicone is used, for example, as the cleaning liquid, it is necessary to select the material of which the platen is made because it is slippery on the platen surface. If the surface of the platen is formed of rubber, it is necessary to select such a cleaning liquid that it never corrodes the rubber.

According to the present invention, as set forth above, it is possible to provide a method for cleaning a thermal head, which ensures an adequate cleaning without requiring any cumbersome operation.

What is claimed is:

1. A method for cleaning a printing surface of a thermal head comprising the steps of:

preparing a compressible sheet impregnated with a cleaning liquid; and passing the cleaning liquid-impregnated compressible sheet between a printing surface of a thermal head and a platen, so as to compress the compressible sheet upon the rotation of the platen so that the sheet is compressed therebetween, the cleaning liquid flows out of the sheet, thus wetting the printing surface, and the sheet wipes the printing surface, to thereby clean the printing surface.

2. The method according to claim 1, wherein said sheet is so impregnated that a forward portion allows said cleaning liquid to be coated on said printing surface upon being compressed between said printing surface of said thermal head and said platen and that a rear portion recovers said cleaning liquid after it has been coated on the printing surface.

3. The method according to claim 1, wherein said sheet is an endless belt.

4. The method according to claim 1, wherein said sheet is a nonwoven sheet.

5. The method according to claim 1, wherein said nonwoven sheet contains over 60% of polyester fibers.

6. The method according to claim 1, wherein said cleaning liquid contains alcohol.

7. The method according to claim 1, wherein said sheet has a forward portion impregnated with said cleaning liquid and a rear portion which is a dried portion for allowing the cleaning liquid to be sucked therein.

8. The method according to claim 3, wherein said endless belt has a width substantially equal to that of said printing surface.

9. A method for cleaning a thermal head with a raised portion formed on a printing surface portion corresponding to a heat generating element, which comprises:

preparing a compressible sheet of nonwoven material;

impregnating an alcohol into a forward portion of the sheet, a rear portion of the sheet remaining dried;

passing the alcohol-impregnated forward portion and a dried rear portion, between a printing surface of a thermal head and a platen, upon the rotation of the platen, so that the sheet is compressed therebetween so as to clean the printing surface with the alcohol impregnated in the forward portion of the nonwoven sheet and such that the alcohol is sucked in the dried rear portion of the nonwoven sheet.

10. The method according to claim 1, wherein said sheet has a width substantially equal to that of said printing surface.

11. The method according to claim 10, wherein said cleaning liquid is impregnated in the entire sheet.

12. The method according to claim 1, wherein said step of preparing said sheet includes a step of preparing a bag containing the sheet and a step of taking the sheet out of the bag.

* * * * *